US005392104A

United States Patent [19]

Johnson

[11] Patent Number: 5,392,104

[45] Date of Patent: Feb. 21, 1995

[54] METHOD AND APPARATUS FOR CREATING COLORGRAPHS HAVING A PHOTOGRAPHIC LOOK AND FEEL FROM IMAGES CREATED ELECTROSTATOGRAPHICALLY

[75] Inventor: Kevin M. Johnson, Rochester, N.Y.

[73] Assignee: Eastman Kodak Company, Rochester, N.Y.

[21] Appl. No.: 11,921

[22] Filed: Feb. 1, 1993

[51] Int. Cl.[6] ..... G03G 21/00

[52] U.S. Cl. ..... 355/278; 156/277; 430/104; 355/285; 355/289; 355/326 R

[58] Field of Search ..... 355/326, 327, 328, 272, 355/278, 285, 289; 156/277; 430/44, 104

[56] References Cited

U.S. PATENT DOCUMENTS

| | | | |
|---|---|---|---|
| 3,091,160 | 5/1963 | Crumrine et al. | 95/1.7 |
| 3,788,930 | 1/1974 | Honjo et al. | 156/307 |
| 3,799,827 | 3/1974 | Takimoto et al. | 430/124 |
| 3,813,267 | 5/1974 | Honjo et al. | 156/236 |
| 3,833,293 | 9/1974 | Serio et al. | 355/17 |
| 4,077,803 | 3/1978 | Gravel | 96/1.1 |
| 4,178,096 | 12/1979 | Lontz | 355/32 |
| 4,287,285 | 9/1981 | Mosehauer | 430/124 |
| 4,470,861 | 9/1984 | Kravig et al. | 156/277 |
| 4,560,426 | 12/1985 | Moraw et al. | 156/277 |
| 4,609,282 | 9/1986 | Crandall | 355/3 SH |
| 4,635,133 | 1/1987 | Nys et al. | 358/298 |
| 4,681,428 | 7/1987 | Devoy | 355/3 SH |
| 4,687,526 | 8/1987 | Wilfert | 156/277 X |
| 4,816,872 | 3/1989 | Okamoto et al. | 355/23 |
| 4,857,961 | 8/1989 | Ogiso et al. | 355/27 |
| 4,920,382 | 4/1990 | Mills et al. | 355/284 |
| 4,937,105 | 6/1990 | Sakai et al. | 427/366 |
| 5,019,869 | 5/1991 | Patton | 355/285 |
| 5,126,797 | 6/1992 | Forest et al. | 355/278 |
| 5,162,874 | 11/1992 | Butler | 356/446 |

*Primary Examiner*—Benjamin R. Fuller
*Assistant Examiner*—John E. Barlow, Jr.
*Attorney, Agent, or Firm*—David A. Howley

[57] ABSTRACT

A method of electrostatographically forming a color print that has the feel of a photographic print. A series of color separation electrostatographic latent images are formed on an image member. A different color toner is applied to each latent image to form a series of different color toner images. A receiver sheet is then fed from a supply of receiver sheets to a transfer member. The receiver sheet is attached to the transfer member. The transfer member is repeatedly rotated to bring the receiver sheet through a nip formed by the imaging member and transfer member to transfer the toner images in registration to the receiver sheet to form a multicolor toner image. The receiver sheet is separated from the transfer member and the toner image is fused to the receiver sheet. A support sheet is then fed into contact with a side of the receiver sheet not having the toner image. The support sheet is adhered to the receiver sheet, the resulting receiver sheet/support sheet combination having the feel of a photographic print. In a preferred embodiment of the invention a transparent sheet is applied over the toner image to provide high gloss to the finished print.

19 Claims, 5 Drawing Sheets

METHOD AND APPARATUS FOR CREATING COLORGRAPHS HAVING A PHOTOGRAPHIC LOOK AND FEEL FROM IMAGES CREATED ELECTROSTATOGRAPHICALLY

TECHNICAL FIELD OF THE INVENTION

The present invention relates generally to electrostatographic image reproduction and, more specifically, to the creation of colorgraphs having a photographic look and feel from images created by such reproduction.

BACKGROUND OF THE INVENTION

Present day electrostatographic copiers and printers can produce high quality black and white, and color images. An example of such an electrostatographic machine is described in U.S. Pat. No. 5,126,797 which issued on Jun. 1992 in the name of Forest et al. These images, as perceived by the human eye, are approaching the quality of images created by conventional photographic processes. It is desirable to be able to electrostatographically make "photographic look and feel" images (colorgraphs) because this process is quick, dry, and produces stable images.

Photographic prints are on stiffer stock largely because of the way they are handled by the consumer. It is easier to handle prints which are on photographic weight paper than prints which are on copier/printer weight paper. In addition, the stiffer stock is much more durable than regular paper and allows photographic prints to last a long time. Thus, consumers have come to expect their photographic quality images to be located on a stiff support.

Unfortunately, many electrostatographic reproduction apparatus have paper paths which bend the receiver sheet around rollers having small diameters. Such an apparatus is disclosed in U.S. Pat. No. 5,162,874 which issued on Nov. 10, 1992 in the name of Butler. There is a limit to the beam strength of receiver sheets which can be bent around these small rollers. If this limit is exceeded the receiver sheet will be damaged and/or there will be a paper jam in the apparatus. In addition, it becomes increasingly more difficult to secure receiver sheets to rollers by, for example vacuums, electrostatic forces and gripper fingers as the beam strength of the receiver sheet increases. As a result, it is difficult to create colorgraphs on an electrostatographic reproduction apparatus using receiver sheets having a rigidity similar to photographic paper.

A further problem is that many electrostatographic apparatus rely on electrostatic transfer to move toner images from a photoconductive or intermediate member to a receiver sheet. The electrostatic forces used in electrostatic transfer must be matched to the receiver sheet to which the toner image is being transferred. If such apparatus are to be able to create images on photographic weight paper as well as copier/printer weight paper the electrostatic forces will have to be varied depending on which weight paper is being used. This makes machine control more difficult. Further, the electrostatic process cannot be optimized for a single weight paper without limiting the output to a single weight paper.

SUMMARY OF THE INVENTION

In view of the foregoing discussion, an object of this invention is to electrostatographically create prints, having a photographic feel, on a stiff receiver sheet.

In accordance with the invention, a toner image is electrostatographically produced on one side of a receiver sheet. A support sheet is adhered to a second side of the receiver sheet to increase its thickness and stiffness thereby providing a print having the feel of a photographic print.

According to a preferred embodiment of the invention, a clear sheet is applied over the toner image to provide gloss to the white and low density areas of the image created. This assists in giving the image a photographic look.

According to a further preferred embodiment of the invention, a ferrotyping belt is used to texturize the surface of the print to provide a photographic look to the print.

The preferred embodiments of the invention provide the advantage of being able to create a colorgraph on an electrostatographic image reproduction apparatus. A further advantage is that electrostatographic apparatus using electrostatic transfer can optimize the transfer parameters without limiting the output of the apparatus to one weight receiver sheet. A still further advantage is that colorgraphs can be made by a dry, quick process which produces stable prints.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
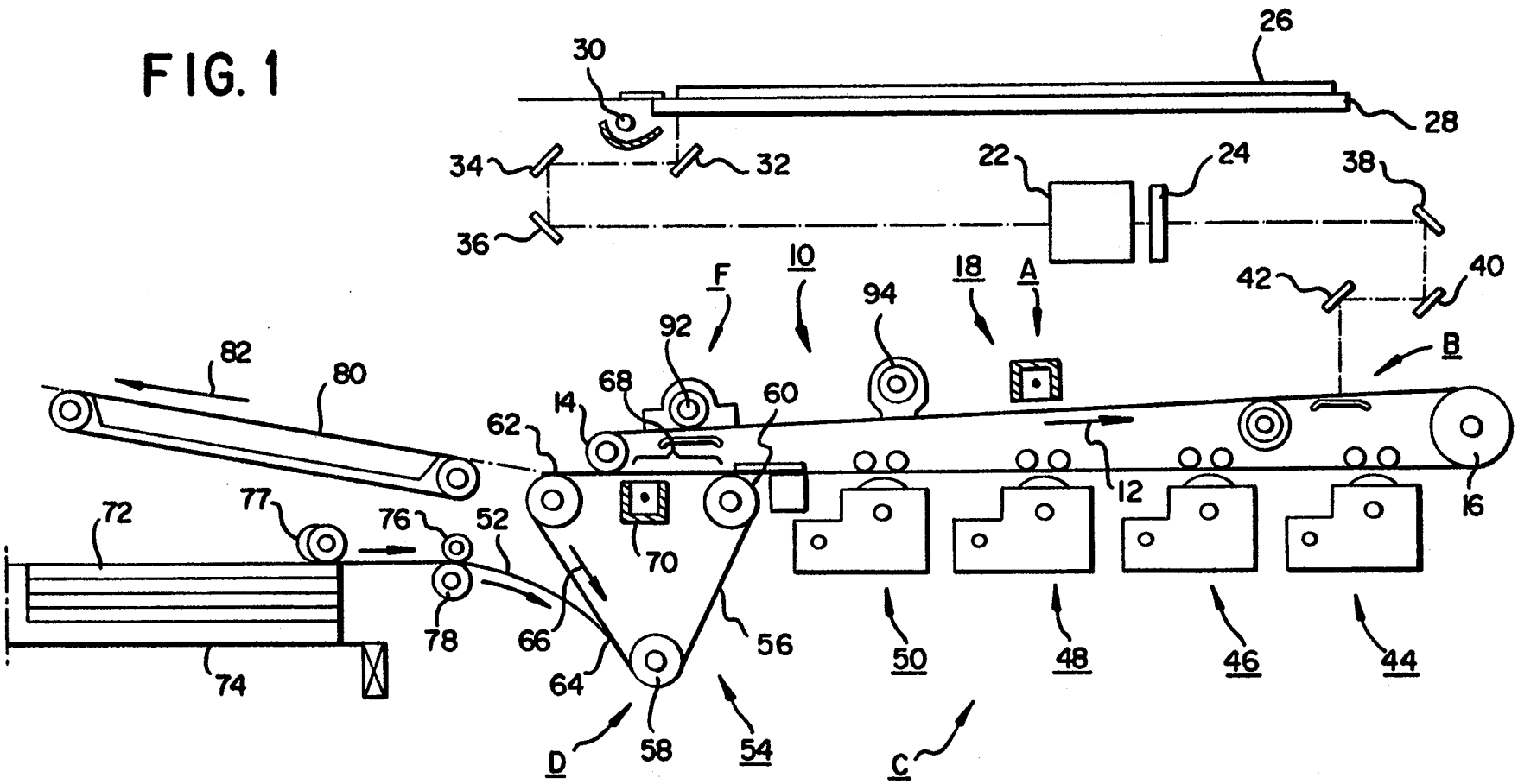
FIG. 1 is a schematic representation of an electrostatographic color printing machine.

For a general understanding of the features of the present invention, reference is made to the drawings. In the drawings, like reference numerals have been used throughout to designate identical elements. FIG, 1 schematically depicts the various components of an illustrative electrostatographic machine. It will become evident from the following discussion that the present invention is equally well suited for use in a wide variety of electrostatographic machines, and is not necessarily limited in its application to the particular electrostatographic machines shown herein.

Inasmuch as the art of electrostatographic image reproduction is well known, the various processing stations employed in the FIG. 1 printing machine will be shown hereinafter schematically and their operation described briefly with reference thereto.

As shown in FIG. 1, the electrophotographic printing machine employs a photoreceptor belt 10, for example, a photoconductive material coated on a grounding layer, which, in turn, is coated on a support. Belt 10 moves in the direction of an arrow 12 to advance successive portions of the photoconductive surface sequentially through the various processing stations disposed about the path of movement thereof. Belt 10 is entrained about an idler roller 14 and a drive roller 16. Idler roller 14 is mounted rotatably so as to rotate with belt 10. Drive roller 16 is rotated by a motor (not shown) coupled thereto by suitable means such as a belt drive. As roller 16 rotates, it advances belt 10 in the direction of arrow 12.

Initially, a portion of photoconductive belt 10 passes through a charging station A. At charging station A, a corona generating device 18 charges photoconductive belt 10 to a relatively high, substantially uniform potential.

Next, the charged photoconductive surface is rotated to an exposure station B. Exposure station B includes a moving lens system 22 and a color filter mechanism 24. An original document 26 is supported in a stationary position upon a transport viewing platen 28. Successive incremental areas of the original document are illuminated by means of a moving lamp assembly 30. Mirrors 32, 34 and 36 reflect the light rays reflected from original document 26 through lens 22. Lens 22 is adapted to scan successive areas of illumination of platen 28. The light rays from lens 22 are transmitted through filter 24 and reflected by mirrors 38, 40 and 42 on to the charged portion of photoconductive belt 10. Lamp assembly 30, mirrors 32, 34 and 36, lens 22, and filter 24 are moved in a timed relationship with respect to the movement of photoconductive belt 10 to produce a flowing light image of the original document on photoconductive belt 10 in a nondistorted manner. During exposure, filter mechanism 24 interposes selected color filters into the optical light path of lens 22. The color filters operate on the light rays passing through the lens to record an electrostatic latent image, i.e. a latent electrostatic charge pattern, on the photoconductive belt corresponding to a specific color of the flowing light image of the original document. The electrostatic latent image recorded on the photoconductive surface of belt 10 is developed with toner, either liquid or powderous, at the development stations (discussed later).

After the electrostatic latent image has been recorded on belt 10, belt 10 advances to a development station C. Station C includes four individual developer units 44, 46, 48 and 50. The developer units 44, 46, 48, and 50 are of a type generally referred to in the arts as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the developer material brush into contact with the photoconductive surface. Developer units 44, 46 and 48, respectively, apply toner particles of a specific color onto the photoconductive surface. Developer unit 50 contains black toner particles and may be used to develop electrostatic latent images formed from black and white original documents.

Each of the developer units 44, 46, 48 and 50 is moved into and out of an operative position. In the operative position, the magnetic brush is closely adjacent to belt 10, while in the non-operative position the magnetic brush is sufficiently spaced therefrom. During development of each electrostatic latent image, only one developer unit is in the operative position with the remaining developer units being in the non-operative position. This insures that each electrostatic latent image is developed with toner particles of the appropriate color without commingling of the various colored toner particles.

After development, the toner image is moved to a transfer station D, where the toner image is transferred to a sheet support material 52, such as plain paper having a weight of 20# (75 g/m$^2$). At transfer station D, a sheet transport apparatus, indicated generally by the reference numeral 54, moves sheet 52 into contact with belt 10. Sheet transport 54 has a pair of spaced belts 56 entrained about three rollers 58, 60 and 62. It can be seen from the spacing and diameter of these rollers that sheet 52 must be flexible enough to bend around the rollers without becoming damaged. This tortuous paper path limits the thickness of receiver sheet which can be used in this apparatus. A gripper 64 extends between belts 56 and moves in unison therewith. Receiver sheet 52 is advanced from a stack of sheets 72 disposed on tray 74. Feed roll 77 advances the uppermost sheet from stack 72 into a nip, defined by forwarding rollers 76 and 78. Forwarding rollers 76 and 78 advance sheet 52 to sheet transport 54 in synchronism with the movement of gripper 64. In this way, the leading edge of sheet 52 arrives at a preselected position to be received by the open gripper 64. Gripper 64 then secures the sheet thereto for movement therewith in a recirculating path. The leading edge of the sheet is releasably secured to gripper 64. As the belts move in the direction of arrow 66, the sheet 52 moves into contact with belt 10, in synchronism with the toner image developed thereon, at transfer zone 68. Corona generating device 70 sprays ions onto the backside of the sheet to charge the sheet to the proper magnitude and polarity for attracting the toner image from photoconductive belt 10 thereto. Sheet 52 remains secured to gripper 64 to move in a recirculating path for three cycles. In this way, three different color toner images are transferred to sheet 52 in superimposed registration with one another. Thus, the aforementioned steps of charging, exposing, developing and transferring are repeated a plurality of cycles to form a multi-color copy of a colored original document.

The last processing station in the direction of movement of belt 10, as indicated by arrow 12, is cleaning station F. A rotatably mounted fibrous brush 92 may be positioned in cleaning station F and maintained in contact with belt 10 to remove residual toner particles remaining after the transfer operation. Thereafter, a lamp 94 illuminates belt 10 to remove any residual charge remaining thereon prior to the start of the next successive cycle.

Figure 2:
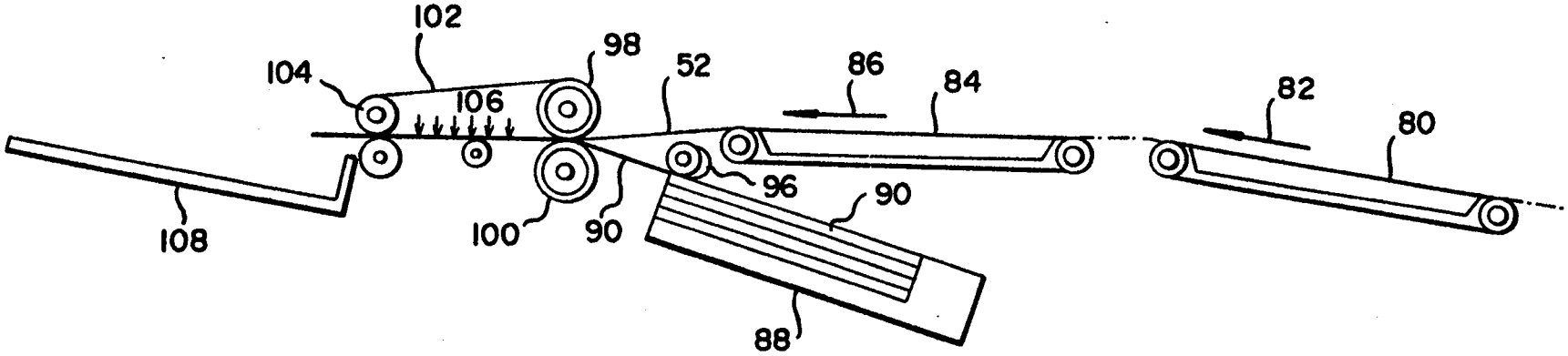
FIG. 2 is another portion of the color printing machine of FIG. 1 which adheres a support sheet to an electrostatographic image.

Referring to FIGS. 1 and 2, after the last transfer operation, gripper 64 opens and releases sheet 52. Conveyer 80 transports sheet 52, in the direction of an arrow 82, to a second conveyer 84 which further transports sheet 52 in the direction of an arrow 86. A tray 88 contains a supply of support sheets 90 which can be made of materials such as plastic or paper having a weight of between about 150–250g/m$^2$. These support sheets have a rigidity such that when a support sheet is adhered to a receiver sheet 52 the resultant product will have a rigidity or beam strength which is about the same as photographic paper. The side of support sheet 90 which faces sheet 52 is coated with a heat sensitive adhesive. A feed roll 96 advances a support sheet 90 from tray 88 such that the lead edge of the support sheet will arrive at a nip formed between a fusing roller 98 and a pressure roller 100 simultaneous with the arrival of a lead edge of sheet 52. Rollers 98 and 100 are pressed together and maintained at a temperature sufficient to both fuse the toner to sheet 52 and activate the heat sensitive adhesive on the support sheet to bond the support sheet to sheet 52. A ferrotyping belt or sheet 102, entrained about rollers 98 and 104, is made of a metal such as Kapton and has a smooth, shiny surface which contacts sheet 52. Cool air 106 is blown on belt 102 to lower the temperature of the toner. Belt 102 provides a photographic glossy look to the toner image on sheet 52. Untoned and low density areas on the receiver sheet will not gloss in this embodiment. This is not usually a problem since the human eye usually recognizes gloss as a reflection off a smooth surface from a specular source. As a result, white "unglossed" areas appear unobjectionable when viewed at most normal angles (e.g., non-glancing angles). The finished product, consisting of sheet 52 adhered to support sheet 90 is deposited in output hopper 108.

Figure 3:
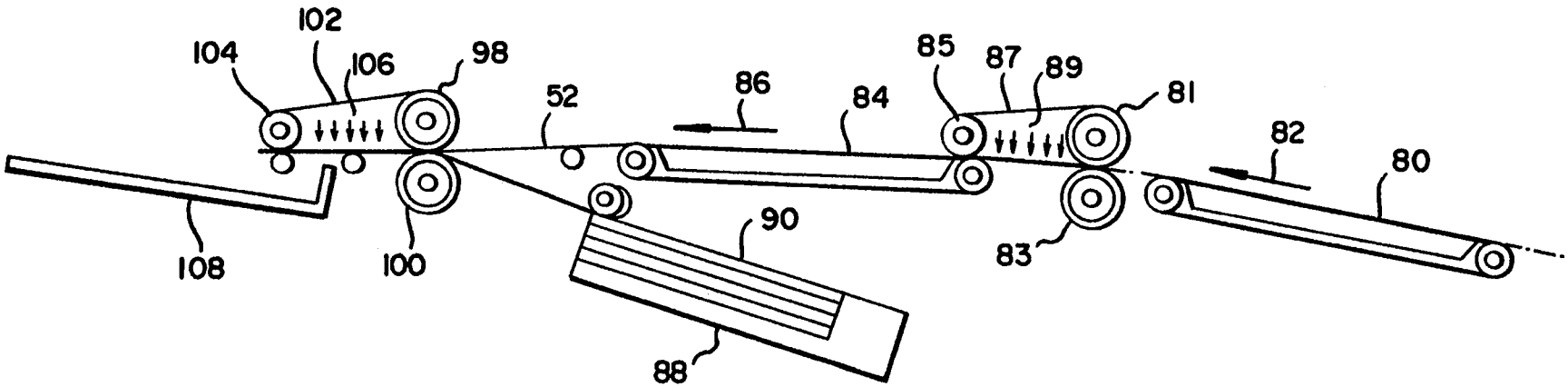
FIG. 3 is an alternative embodiment of the portion of the color printing machine depicted in FIG. 2.

Turning now to FIG. 3, another embodiment of the FIG. 2 portions of the image forming apparatus of FIG. 1 is represented. In this embodiment, the toner image is fused by a fusing roller 81 and a pressure roller 83 prior to attaching a support sheet 90 to sheet 52. A ferrotyping belt or sheet 87, entrained about rollers 81 and 85, is used to provide a photographic glossy look to the toner image. Belt 87 is preferably made of a material similar to belt 102 and has a smooth, shiny surface. Cool air 89 is blown onto belt 87 to lower the temperature of the toner. After the toner image on sheet 52 is fused and ferrotyped, it is advanced in the direction of arrow 86 by conveyer 84 to rollers 98 and 100. These rollers are maintained at a temperature sufficient to activate the heat sensitive adhesive on sheet 90. In this embodiment, belt 102 has a texturized surface, such as a matte surface, to provide a texture to the toner image. This further assists in providing a "photographic look" to the toner image. The finished print is deposited in hopper 108. Of course, the toner image could be fused in one machine while having a support sheet 90 attached to sheet 52 in another machine.

Figure 4:
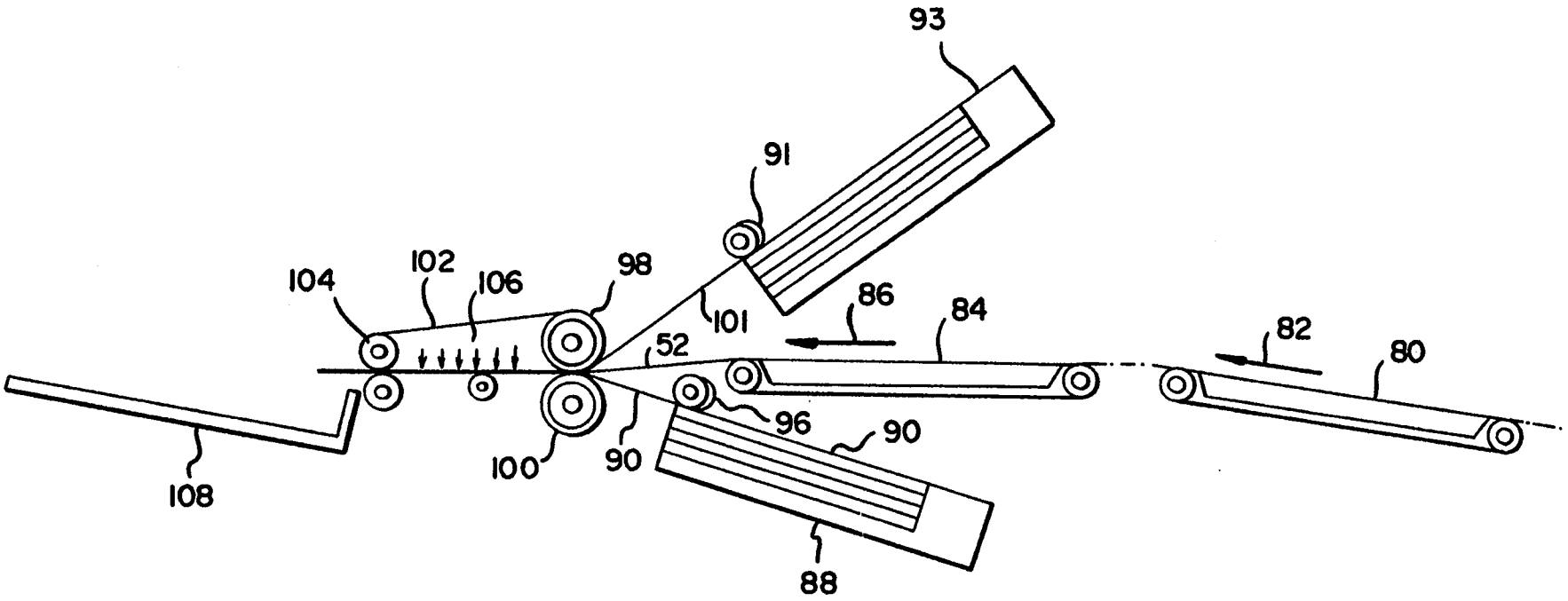
FIG. 4 is an alternative embodiment of the portion of the color printing machine depicted in FIG. 2.

Turning now to FIG. 4, yet another embodiment of the FIG. 2 portions of the image forming apparatus of FIG. 1 is represented. In this embodiment, a transparent sheet 101 is fed by feed roll 91 from tray 93 into overlying contact with the toner image on receiving sheet 52. As the three sheets pass through the rollers 98 and 100 they are adhered together. The resulting sandwich provides an image having excellent gloss in all areas, including those having little or no toner.

If the toner image covers a substantial portion of the receiving sheet, the adhesive tendency of the toner itself may be sufficient to hold the transparent sheet and the receiver sheet together once it has been softened by the fusing rollers. However, some toner images may not contain adequate toner to reliably hold the sheets together. Accordingly, it is preferable to have a side of at least one of the sheets, preferably the transparent sheet, coated with a thermoplastic having a glass transition or melting temperature similar to that of the toner.

Although the support sheets are shown in FIGS. 2–4 as individually cut sheets, the support sheet can be a long sheet in roll form. After the support sheet is attached to the image bearing sheet to form a finished product the finished product is excised from the support sheet by a cutter. See, for example, United Kingdom Patent Application 2,150,885, published Jul. 10, 1985.

Figure 5:
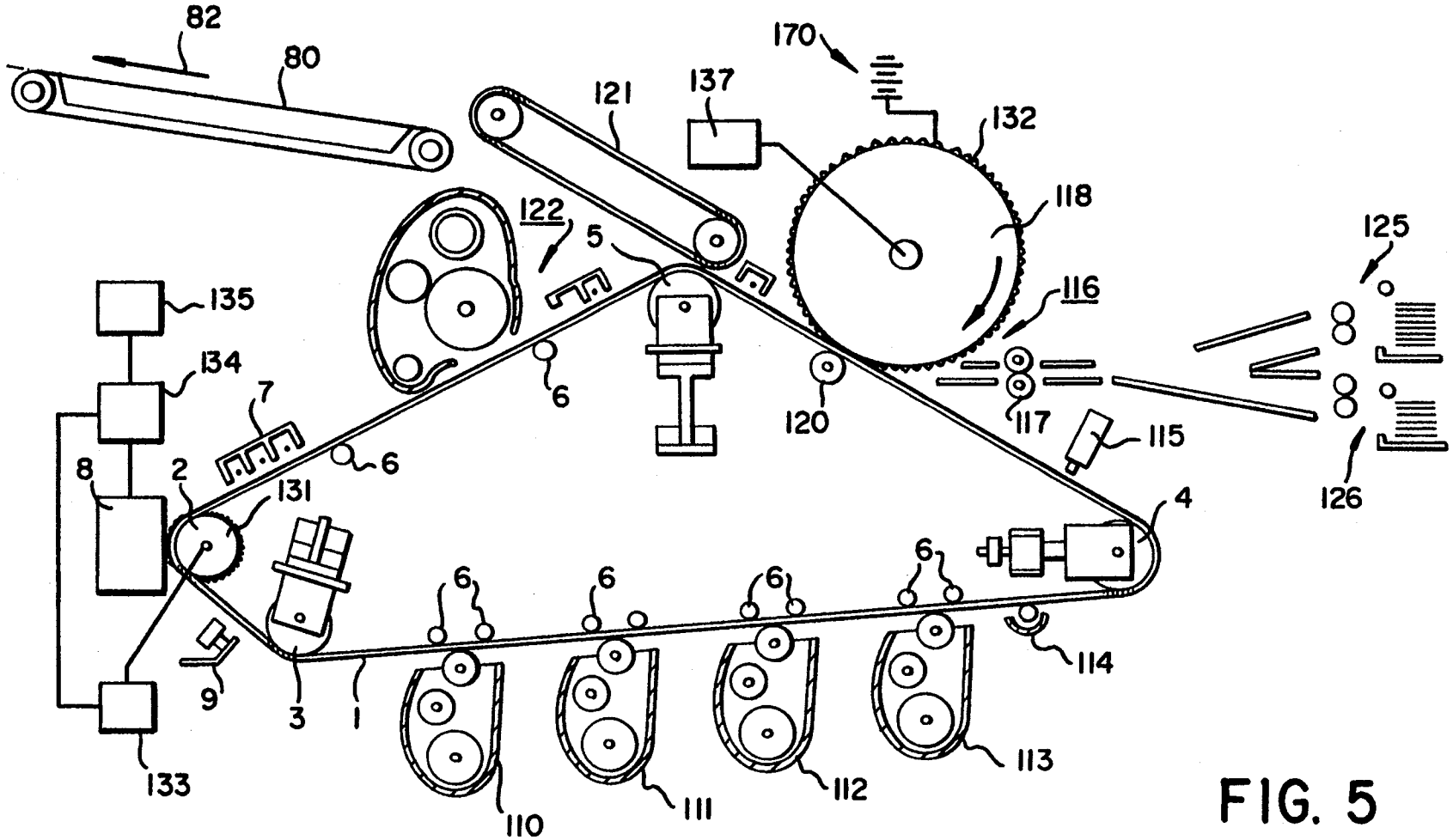
FIG. 5 is schematic representation of another electrostatographic color printing machine which can adhere a support sheet to one side of a receiver sheet and a clear sheet to the other side having an image thereon.

FIG. 5 represents another embodiment of an electrostatographic machine in which the present invention may be utilized. A film core portion of a copier or printer includes an image bearing member, for example, an endless electrophotoconductive web 1 mounted about a series of primary rollers 2, 3, 4 and 5, and other supporting structure, for example, film ski 6.

Web 1 is driven through a series of electrophotographic stations generally well-known in the art. More specifically, a uniform charge is laid down on web 1 by a charging station 7. The uniformly charged web moves around printhead roller 2 which is directly opposite an LED printhead 8 which LED printhead exposes the web in a manner well-known in the art. The web then moves into operative relation with an electrometer 9 which senses the level of charge after exposure of the web by printhead 8, to help control the process.

The web then moves into operative relation with a series of toning or developing stations 110, 111, 112 and 113. Each image created by printhead 8 is toned by one of the toning stations. After being toned the web passes a magnetic scavenger 114 which removes excess iron particles picked up in the toning process. After the electrostatic image has been toned the web passes under a densitometer 115 which measures the density of the toner image also for use in controlling the process. The toner image then proceeds to a transfer station 116 where the image is transferred to a receiving sheet carried by a transfer drum 118.

Transfer drum 118 includes vacuum holes for securing the receiving sheet for repeated presentations to web 1. Transfer drum 118 cooperates with web 1 to incrementally bring the receiving sheet and the toner image into transfer relation so that the toner image is transferred to the receiving sheet. As is well known in the art, this is generally accomplished in the presence of an electric field which is created by biasing the transfer drum by a suitable biasing means, for example, electrical source 170, compared to the conductive layer of web 1 or to a backing roller 120 for the web. When the apparatus is operating in a multi-image mode, for example, a multicolor mode, consecutive images or pairs of images are toned with different colored toners using the different toning stations 110–113. These consecutive images are transferred in registry to the receiving sheet as it repeatedly is brought into transfer relation with web 1 by drum 118. After the transfer operation is complete, the receiving sheet is allowed to follow the web, for example by removing the vacuum holding it to drum 118 or by stripping the sheet with a skive, other conventional stripping mechanism or both. The receiving sheet is separated from the web with the aid of an electrostatic sheet transport mechanism 21 and is transported to conveyer 80. The web is then cleaned by the application of a neutralizing corona, a neutralizing erase lamp and a magnetic brush cleaning mechanism all located at a cleaning station 122.

The transfer drum 118 is driven by a motor 137, the drum 118 in turn driving web 1 through a sprocket 132 which engages perforations in web 1. Sprocket 32 also forms part of a registration and timing system which includes a sprocket 131 on printhead roller 2 which sprocket is linked to an encoder 133. Encoder 133 feeds signals indicative of the angular position of sprocket 131 to a drive 134 for printhead 8 which drive 134 times the application of information from an information source 135 to printhead 8.

Transfer station 116 receives sheets from either of two sources. First, it can receive sheets of one particular size from a first supply hopper 125, which first supply hopper may include, for example, letter size sheets being fed with their short dimension parallel with the direction of feed. Second, it may receive sheets from a second supply hopper 126, which, for example, may include ledger size sheets with their long dimension parallel to the direction of movement. These two supply hoppers 125 and 126 together constitute the copy sheet supply means of the apparatus. The receiver sheets from hoppers 125 or 126 stop against timing roller 117. In response to a signal from the logic and control of the apparatus, not shown, timing rollers 117 accelerate to drive the receiving sheet into the nip between transfer drum 118 and web 1 as the first toner image to be transferred approaches the nip.

The above is an adequate description of the operation of the apparatus shown at FIG. 5 for making multicolor images. However, white or low density areas of an image will not gloss even after ferrotyping because of an insufficient amount of toner in these areas. A solution is to overlay a permanent, clear laminate on the image to create the glossy look.

Figure 6:
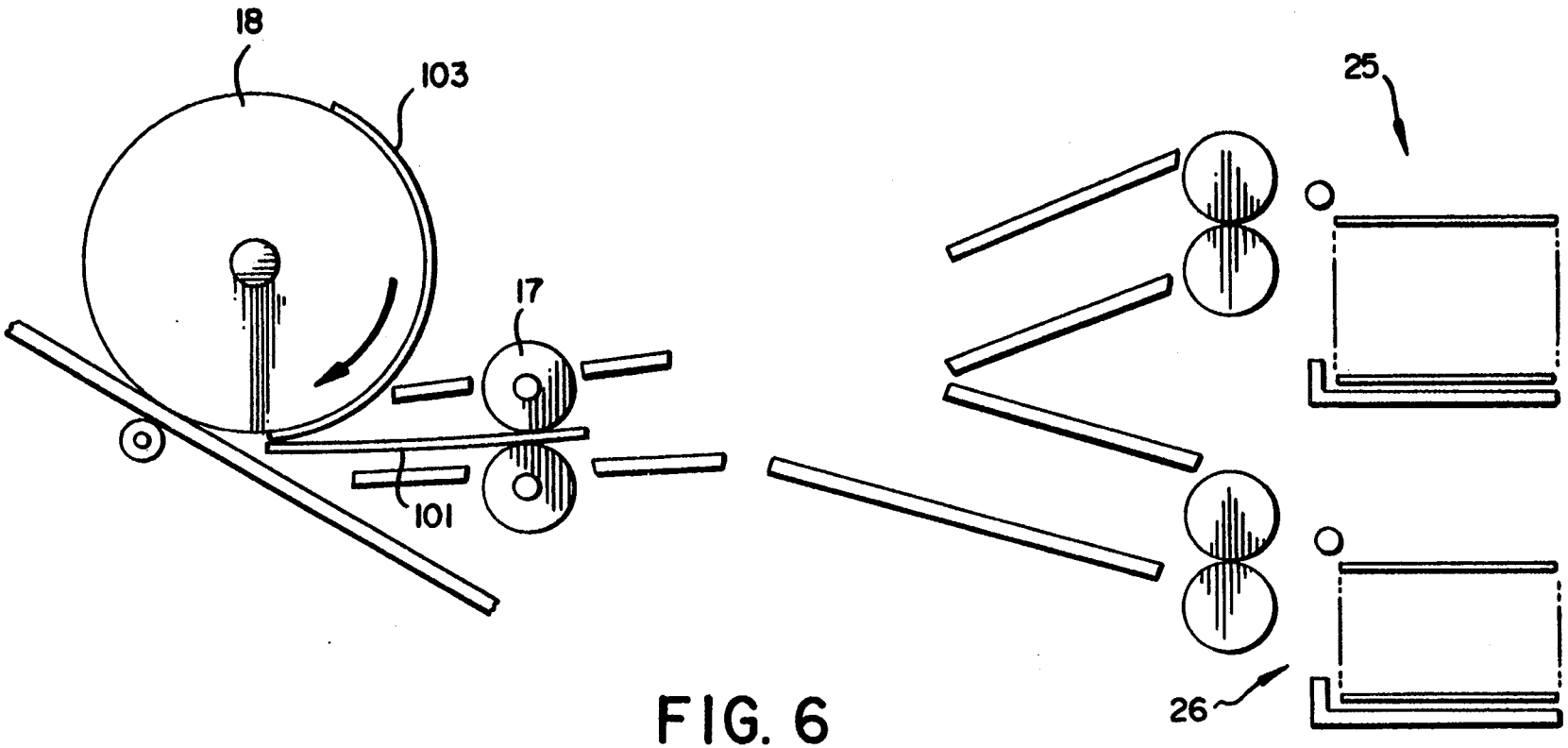
FIG. 6 is a view of a portion of the electrostatographic printing machine of FIG. 4.

With reference to FIGS. 5 and 6, a receiving sheet 103, is fed out of either supply hopper 125 or supply 126 and through timing rollers 117 and into contact with drum 118 to receive a toner image carried on image member 1. As seen in FIG. 5, receiving sheet 103 is secured to approximately one-half of the circumference of transfer drum 118 for repeated rotation into transfer relation with image bearing member 1 to receive a separate color toner image on its outside surface for each revolution of drum 118.

Meanwhile, a transparent sheet 101 is fed from one of supply hoppers 125 or 126 to timing rollers 117. After the last image has been transferred to first receiving sheet 103, drum 118 makes an additional revolution and sheet 101 is fed by timing rollers 117 into overlying contact with the toner image on receiving sheet 103 as shown in FIG. 4. The two sheets adhere to each other electrostatically, forming a sandwich, as they are fed back through the transfer nip, separated from the transfer roller and fed through the copy sheet path of the reproduction machine shown in FIGS. 5 and 2 to transport 121 and conveyer 82. A support sheet is attached to sheet 103 on the side not contacting laminating sheet 101. The support sheet is attached as described with respect to FIG. 2 above except that, because the toner image in this embodiment is on the bottom of sheet 103, the support sheet is fed on top of, rather than under, sheet 103. As the three sheets pass through the rollers 98 and 100 they are adhered together. The resulting laminated sandwich provides an image having excellent gloss.

For convenience the receiving sheets can be fed from a stack in one supply hopper and the transparent sheets from a stack in the other supply hopper. Alternatively, the sheets may be alternated prior to loading as a single stack in one of the supply hoppers. Note however that the FIG. 6 embodiment requires that the receiving sheet have the thermoplastic facing down in the supply hopper while the transparent sheet would have the thermoplastic facing up. This embodiment allows applying a transparent sheet over a toner image on a receiving sheet without adding additional structure to the copy sheet path in a copier or printer and without manually handling the receiver sheets between the initial transfer and the application of the transparent sheet.

In another embodiment of the invention a transparent sheet is not used. Rather, an additional developer unit, containing clear toner, is included in the reproduction apparatus. A clear toner image of at least the white and low density areas of the original image is created and registered with the other color toner images. The clear toner, when fused, will give a glossy appearance to the white and low density areas of the print.

The invention has been described in detail with particular reference to preferred embodiments thereof, but it will be understood that variations and modifications can be effected within the spirit and scope of the invention. Although the invention has been described in terms of a multicolor imaging apparatus, the invention can be utilized in a monocolor (e.g. black and white) imaging apparatus.

What is claimed is:

1. A method of forming a color print comprising the steps of:

forming a series of color separation electrostatic latent images on an image member;

applying a different color toner to each latent image to form a series of different color toner images;

forming an electrostatic latent image on the image member of the white and low density areas of an original image;

applying clear toner to this latent image to form a clear toner image on the image member;

feeding a receiver sheet from a supply of receiver sheets to a transfer member;

attaching the receiver sheet to the transfer member;

repeatedly rotating the transfer member to bring the receiver sheet through a nip formed by the imaging member and transfer member to transfer the toner images in registration to the receiver sheet to form a multicolor toner image;

separating the receiver sheet from the transfer member;

fusing the toner image to the receiver sheet;

feeding a single support sheet having a weight not greater than 250 $g/m^2$ into contact with a side of the receiver sheet not having the toner image; and adhering the support sheet to the receiver sheet to form a receiver sheet-support sheet combination having the feel of a photographic print.

2. A method of forming a print comprising the steps of:

forming a first electrostatic latent image on an image member;

applying toner to said first latent image to form a toner image;

transferring said toner image to a receiver sheet;

forming a second electrostatic latent image of the white and low density areas of an original image;

applying clear toner to the second latent image to form a clear toner image;

registering the clear toner image with the toner image;

fusing the toner images to the receiver sheet;

feeding a support sheet into contact with a side of the receiver sheet not having the toner images; and adhering the support sheet to the receiver sheet to form a receiver sheet-support sheet combination having the feel of a photographic print.

3. The method of claim 2, further comprising the steps of:

overlaying a transparent sheet on the toner image; and adhering the transparent sheet to the receiver sheet.

4. The method of claim 2 wherein said fusing step and said adhering step are done at essentially the same time.

5. The method of claim 2 wherein said fusing step is accomplished prior to accomplishing said adhering step.

6. The method of claim 2 further comprising the step of;

ferrotyping the toner image to provide a smooth, glossy look to the toner image.

7. The method of claim 2 further comprising the step of;

ferrotyping the toner image to provide a matte finish to the toner image.

8. A method for making a print having the feel of a photographic print, said method comprising the steps of:

electrostatographically producing a toner image on a receiver sheet;

forming an electrostatic latent image of the white and low density areas of an original image;

applying clear toner to this latent image to form a clear toner image;

registering the clear toner image with the toner image;

fusing the toner images;

adhering said receiver sheet to a flexible support to increase the receiver sheet's thickness and stiffness, and to provide a print having the feel of a photographic print, the flexible support contacting the receiver sheet on a side not having the toner image.

9. The method of claim 8, further comprising the steps of:

overlaying a transparent sheet on the toner image; and adhering the transparent sheet to the receiver sheet to increase the gloss of said toner image.

10. The method of claim 8 further comprising the step of;

ferrotyping the toner image to provide a smooth, glossy look to the toner image.

11. The method of claim 8 further comprising the step of;

ferrotyping the toner image to provide a matte finish to the toner image.

12. The method of claim 8 further including the step of:

fusing the toner image to the receiver sheet.

13. The method of claim 12 wherein said fusing step and said adhering step are done at essentially the same time.

14. The method of claim 12 wherein said fusing step is accomplished prior to accomplishing said adhering step.

15. Apparatus for making a print having the feel of a photographic print, comprising:

means for electrostatographically creating a toner image on a receiver sheet; and means for forming an electrostatic latent image of the white and low density areas of an original image;

means for applying clear toner to this latent image to form a clear toner image;

means for registering the clear toner image with the toner image;

means for fusing the toner images means for adhering said receiver sheet to a flexible support to increase the receiver sheet's thickness and stiffness, and to provide a print having the feel of a photographic print.

16. The apparatus of claim 15, further comprising:

means for overlaying a transparent sheet on the toner image; and means for adhering the transparent sheet to the receiver sheet to increase the gloss of the toner image.

17. The apparatus of claim 15 further comprising:

means for fusing the toner image to the receiver sheet.

18. The apparatus of claim 15 further comprising;

means for ferrotyping the toner image to provide a smooth, glossy look to the toner image.

19. The apparatus of claim 15 further comprising;

means for ferrotyping the toner image to provide a matte finish to the toner image.

* * * * *